US005425862A

United States Patent [19]

Hartmann et al.

[11] Patent Number: 5,425,862

[45] Date of Patent: Jun. 20, 1995

[54] APPARATUS FOR THE ELECTROPLATING OF THIN PLASTIC FILMS

[75] Inventors: Bernd Hartmann, Hattorf, Germany; Abraham Holtzmann, Bat-Yam, Israel; Rainer Haas, Herrenberg; Werner Renz, Pforzheim, both of Germany

[73] Assignee: Hans Hollmuller Maschinenbau GmbH & Co, Herrenberg, Germany

[21] Appl. No.: 205,485

[22] Filed: Mar. 3, 1994

[51] Int. Cl.[6] ..... C25D 5/56

[52] U.S. Cl. ..... 204/207; 204/211; 204/236; 204/241

[58] Field of Search ..... 205/96, 101, 107, 125, 205/138, 164, 206, 222, 292, 920; 204/206, 207, 211, 236, 234, 241

[56] References Cited

U.S. PATENT DOCUMENTS

| | | | |
|---|---|---|---|
| 3,894,924 | 7/1975 | Toledo | 204/206 |
| 4,046,649 | 9/1977 | Elco | 205/107 |
| 4,322,280 | 3/1982 | Houska | 204/207 |
| 5,015,538 | 5/1991 | Krause | 428/626 |
| 5,100,517 | 3/1992 | Starinshak | 205/138 |
| 5,181,997 | 1/1993 | Kaneko | 204/129.1 |

*Primary Examiner*—John Niebling
*Assistant Examiner*—Brendan Mee
*Attorney, Agent, or Firm*—Lowe, Price, LeBlanc & Becker

[57] ABSTRACT

Apparatus for the electroplating of thin plastic films (1), which are provided on one or both sides with a conductive coating and, if appropriate, may be provided with through-holes, comprises a conveying device (20 to 23) which moves the plastic film (1) horizontally in the region of the chamber (6) filled with electrolyte. The bonding devices (9 to 16), which bring the plastic film (1) to cathodic potential, are located outside the chamber (6) in the "dry". The conveying device includes at least one pair of squeezing rolls at both the inlet and the outlet of chamber (6), the circumferential speed of the pairs of squeezing rolls increasing in the direction of movement of the plastic film (1).

31 Claims, 4 Drawing Sheets

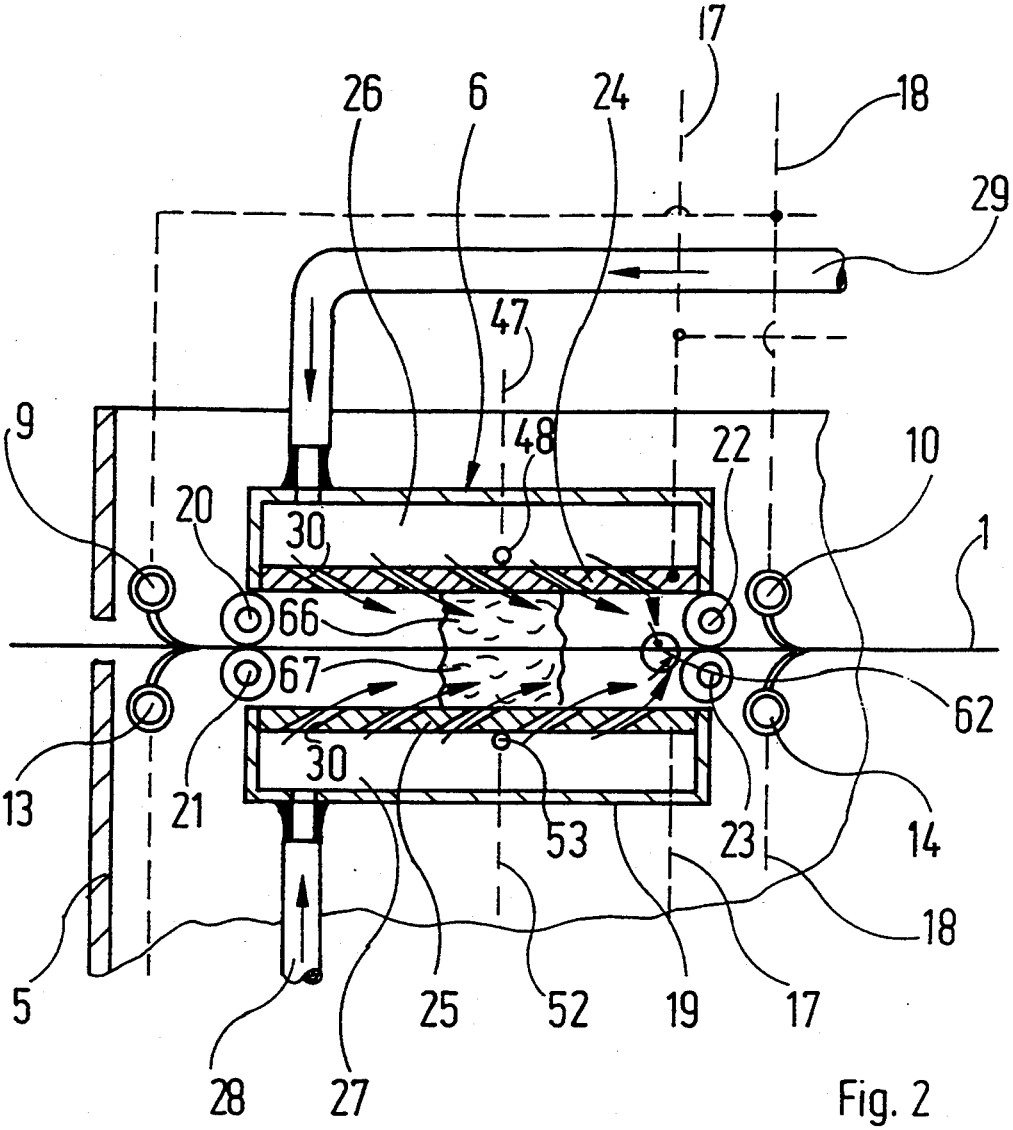
Fig. 2
Fig. 3
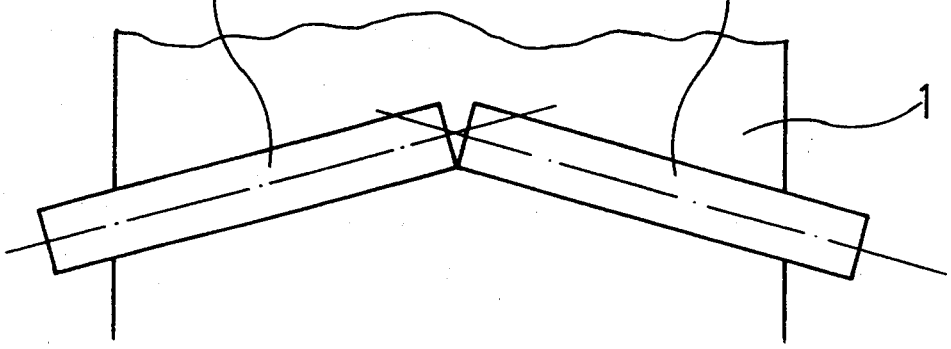

APPARATUS FOR THE ELECTROPLATING OF THIN PLASTIC FILMS

FIELD OF THE INVENTION

The invention relates to an apparatus for the electroplating of thin plastic films, provided on one or both sides with a conductive coating.

BACKGROUND TO THE INVENTION

Conventional printed circuit boards are discrete workpieces which bear a certain circuit configuration on a rigid substrate, if appropriate on both sides. The circuit configurations on the opposite sides can be electrically connected to each other via through-holes, the lateral surfaces of which have been provided with a metallic coating by electroplating. Similarly constructed are the so-called multilayer inner coatings. These are likewise discrete items, which however comprise a flexible substrate and, stacked one on top of the other, are connected to one another to form a three-dimensional circuit. There is a development towards replacing these discrete circuit boards or multilayer inner coatings by thin plastic films into which the required through-holes are made by special dry plasma-etching processes. These processes are not only considerably less expensive than mechanical drilling, they additionally allow the production of through-holes of diameters smaller than can be achieved by mechanical means. The through-bores obtained have, moreover, an extremely favourable aspect ratio, that is the ratio of length to diameter of the through-hole. The handling of the plastic film is also much easier than that of the discrete circuit boards. This applies all the more so in comparison with discrete pieces of film, which are extremely difficult to process.

The plastic films are provided on the surfaces to be electroplated with a conductive coating. On the planar "main surfaces", this conductive coating is generally composed of metal, whereas the lateral surfaces of any existing through-holes are often made conductive by a suitable polymer layer. When "plastic film" is mentioned hereinafter, it is always intended to be a simple way of referring to the coated plastic film.

Known apparatus for the electroplating of such thin plastic films, which are generally produced from polyimide, operate such that they pass the plastic film in the electrolyte repeatedly up and down in a serpentine manner between lower and upper deflecting rolls. It is intended by this to keep the dimensions of the electroplating apparatus small, while maintaining a long path of movement of the plastic film in the bath. However, such apparatus are very complex in their construction; the repeated deflection about tile upper and lower deflecting rolls can mechanically impair the metal layers as they are formed.

The present invention seeks to provide apparatus for the electroplating of thin plastic films that it is simple in mechanical construction, without requiring greater dimensions and without impairing the plating operation itself.

Accordingly, the invention provides apparatus for the electroplating of thin plastic films, provided on one or both sides with a conductive coating, which comprises a) at least one assigned supply reel for the plastic film to be electroplated;

b) at least one assigned supply reel for the electroplated plastic film;

c) a conveying device which conveys the plastic film continuously from one supply reel to the other;

d) at least one chamber which can be charged with electrolyte, which chamber lies between the supply reels and in which there is located in the vicinity of the path of movement of the plastic film at least one anode which is electrically connected to the one pole of an electroplating current source;

e) at least one bonding device which is electrically connected to the other pole of the electroplating current source and establishes contact with the moving plastic film, in which the conveying device is set up in such a way that the plastic film runs horizontally in the entire region of the chamber which can be charged with electrolyte.

According to the invention, the plastic film in the electrolyte bath can be kept horizontal during the electrolysis operation. The lengthening of the path that has been achieved previously by passing the film up and down in a serpentine form, is dispensed with completely. Within the same dimensions in the direction of movement of the plastic film, the apparatus according to the invention provides a path for the film in the electrolyte is shorter than in the case of the known apparatus; however, this is compensated by the fact that the geometrical relationships in the way in which the plastic film is passed through the electrolyte according to the invention are considerably more favourable. In particular, the flowing of electrolyte onto the plastic film can be designed such that no depletion and concentration effects occur.

In this case, it is known per se from DE-A-3624481 or DE-A-3236545 to electroplate discrete circuit boards of a conventional type running horizontally through. In the case of these discrete circuit boards however, there is no possibility of upward and downward movement in a serpentine form in the electrolyte bath with a tub of design which is to some extent reasonable in its complexity.

The bonding device should in this case be arranged outside the chamber which can be charged with electrolyte. This is a further advantage of the endless plastic film in comparison with discrete circuit boards: the bonding does not have to take place in the electrolyte itself, where metal would likewise be deposited on the bonding device. This represents a considerable problem in the case of the known apparatus for producing discrete circuit boards.

Preferably, the chamber for electrolyte is subdivided into a plurality of electroplating chambers which are arranged one behind the other, in the direction of movement of the plastic film. This is of significance in particular if, as mentioned above, the bonding is to take place outside the electrolyte. However, the spacing between two bonding devices following one behind the other in the direction of movement of the plastic film should preferably not be too great, so that that voltage drops within the plastic film do not result in non-uniform electroplating.

It is therefore preferable for the bonding devices to be arranged upstream of, between and downstream of the electroplating chambers. The length of the individual electroplating chambers is then governed by the permissible voltage drop within the plastic film.

Preferably, at the inlet and at the outlet of each electroplating chamber there is arranged at least one pair of squeezing rolls, which serve as the only conveying device, that is to say that no additional conveying devices, such as transport rollers, are provided between the pairs of squeezing rolls at the inlet and at the outlet. Rather, the plastic film freely spans the entire electroplating chamber between the pair of squeezing rolls at the inlet and the pair of squeezing rolls at the outlet. This type of construction is particularly inexpensive. In addition, the risk of distortions of the plastic film when running through the entire apparatus drops all the more the smaller the number of places at which the plastic film is held firm.

It goes without saying that the plastic film must not bend within the electroplating chamber to such an extent that one of the neighbouring anodes is touched. In general (as long as the aspect mentioned above of the voltage drop docks not apply), the electroplating chambers can be kept all greater in length the better the plastic film is kept taut. Various possibilities are available for this. For example, at the inlet and at the outlet of each electroplating chamber there may be in each case two pairs of squeezing rolls arranged in such a way that they converge toward each other in the direction of movement of the plastic film and enclose an obtuse angle. If these pairs of squeezing rolls are driven, they draw the plastic film not only in the desired conveying direction but also at the same time perpendicularly to the latter outward, which effects a transverse tautening.

The obtuse angle may be from about 120° to about 190°, preferably about 150°.

If, as often happens in the case of discrete circuit boards, the bonding device is formed by lateral pairs of contact rollers, a similar effect can also be accomplished by the axes of pairs of contact rollers lying opposite one another on both sides of the plastic film converging toward each other in the direction of movement of the plastic film and enclosing an obtuse angle.

A tautening of the plastic film in the direction of movement can be achieved by the circumferential speed of the pairs of squeezing rolls increasing in the direction of movement of the plastic film. The pairs of squeezing rolls following in the direction of movement thus attempt to draw the plastic film away slightly more quickly all the time than it is being supplied by the upstream pairs of squeezing rolls. In this way, there is always some slip, which in the simplest case takes place between the pairs of squeezing rolls and the plastic film itself.

The increasing circumferential speed of the pairs of squeezing rolls can be achieved again in various ways. For example, with a view to the drive technique, it can be preferred for the diameter of the pairs of squeezing rolls to increase in the direction of movement of the plastic film. The rotational speed of all the pairs of squeezing rolls in the apparatus can then be the same; all the pairs of squeezing rolls can be set in rotation from the same drive shaft with the same transmission ratio. Alternatively or in addition, the rotational speed of the pairs of squeezing rolls can increase in the direction of movement of the plastic film. Then, the diameter of all the pairs of squeezing rolls in the apparatus can be constant. This facilitates stock-keeping.

It goes without saying that the sensitive plastic film and the metal layer deposited thereupon must not be mechanically damaged by the pairs of squeezing rolls. This could be the case if, owing to differing circumferential speed, this slip becomes too great. It is therefore recommendable to provide for each squeezing roll a slip clutch which limits the torque transferred to the lateral surface of the squeezing rolls to a maximum value. The apparatus is then preferably operated such that the slip clutches are always in operation, the slip taking place in the slip clutch and not between the circumferential surface of the squeezing roll and the surface of the plastic film.

The "span", that is the length of the electroplating chamber which can be freely spanned by the plastic film, can be extended, if appropriate, by there being provided inside the chamber, on both sides between the plastic film and a stationary part, a tampon of soft, open-pored plastic foam. The plastic foam is permeable to the electrolyte, that is it does not hinder the electrolysis. In spite of the-softness of the material, the tampon does, however, lend the plastic film a certain stability, so that in particular sporadic yielding or buckling out is made more difficult.

Preferably, the stationary parts are anodes.

Pursuing the same aim is the measure that the holes by which the electrolyte enters into the chamber which can be charged with electrolyte are designed symmetrically on both sides of the plastic film. Then the compressive forces exerted by the inflowing electrolyte on the plastic film compensate one another, so that in turn bending or buckling out in one direction is avoided.

In this case, that design in which the holes are disposed obliquely in such a way that they converge toward one another in the direction of movement of the plastic film proves in turn to be particularly favourable. Thus, the electrolyte is also introduced correspondingly obliquely into the field-filled space of the electrolysis. It has in this case a movement component which is directed parallel to the path of movement of the film and consequently to the film surfaces themselves. On account of the favourable aspect ratio of the through-holes in the plastic film, the lateral surfaces of said holes are nevertheless completely electroplated.

The holes may be formed in the anodes.

As already mentioned above, the spacing of neighbouring bonding devices in the direction of movement of the plastic film is determined substantially by the inner voltage drops in the plastic film. It is so that the conductivity of the plastic film increases during the electroplating operation. Therefore, in an embodiment of the invention, the length of the electroplating chambers can increase in the direction of movement of the plastic film. The respective longitudinal dimensions of the electroplating chambers can be matched to the progressive layer build-up such that, with the same external voltage, it is substantially the same current density that is used everywhere.

However, this aim is not desirable in all cases. Often it may also be preferable for the initial build-up of the metallic layer in the electrolysis initially to take place with lower current densities; the further reinforcing of the metal layer during the course of the electrolysis can then take place with increasing current density. According to one design of the invention, this can be accomplished in a simple manner by all the electroplating chambers in the apparatus having the same length. Since the metallization is already further advanced in the second electroplating chamber, and therefore the conductivity of the plastic film is enhanced, the current density is inevitably greater than in the first electroplating chamber, and so on.

If the current density is to be controlled precisely and, if appropriate, also in adaptation to the plastic film respectively being processed, the potential lying across the anodes of the various electroplating chambers may also differ at least to some extent. This is an additional advantage of the division of the chamber into individual electroplating chambers lying one behind the other.

As already mentioned above, the basic idea of the apparatus according to the invention provides adequate electroplating of a plastic film despite a short residence time in the electrolyte. This result can be enhanced by using an electroplating current source which comprises at least one adjustable pulse generator, the output signals of which are applied to the anode and the bonding device and are square-wave pulses of selectable repetition frequency, clock ratio, amplitude and polarity, the anode being positive on average over time with respect to the bonding device.

It has surprisingly been found that the plating rate can be increased by a multiple if, instead of a constant direct voltage, a pulsed direct voltage is applied at the electrodes of the electrolysis, that is at the anode on the one hand and the plastic film to be electroplated on the other hand. The zero current periods which lie between the individual pulses are compensated by correspondingly increasing the amplitude of the pulses. With the same current consumption, the deposition rate in the case of an apparatus according to the invention, and consequently the current yield, is considerably higher than in the case of the prior art. The physical processes on which this is based have not yet been researched in detail. However, it appears to have been established that a part is played in this by concentration and polarization effects in the region of the anodes and of the plastic films to be plated, which can be favourably influenced in the case of pulsed operation. In particular, the penetration of the metal ions through the double charge layer in the region of the plastic films to be plated should be favoured by the higher voltages which can be employed in the process according to the invention, so that the deposition of metal is facilitated. The precise parameters of the output signals generated by the pulse generator, that is in particular the repetition frequency, the clock ratio and the amplitude, can be optimized by tests and thus adapted to the given geometrical conditions as well as to the particular electrolyte in each case. Different electrolytes, that is in particular different types of metal ions and different additives, may necessitate different types of pulses.

It can be particularly preferred for the electroplating current source to comprise at least two pulse generators which are operated independently of each other and the added output signals of which are applied to the anode and the bonding device, respectively, and the relative phase position of which is adjustable. By the superposing of a plurality of square-wave pulses, in particular two, generated by the independent pulse generators, the characteristic parameters of which pulses can be selected independently of one another, it is possible to compose very differentiated overall pulses, which leads to favourable results.

Particularly fast electroplating rates are accomplished with an embodiment of the invention in which the pulse generator or generators generate such output signals that, during part of the time, the voltage effectively lying across the anode or the bonding device has the reverse polarity, at which the anode is negative with respect to the bonding device. This temporary reversal of the polarity of the operating voltage seems to eliminate in particular disadvantageous concentration effects. It is also possible that this in each case involves a small part of the layer already plated on beforehand going back into solution again, which frees the surface of adhering impurities. In particular, hydrogen embrittlement of the deposited layer is also avoided as a result.

The repetition frequency of the output signals of the pulse generator may be from about 0.1 to about 10,000 Hz.

In many cases, preferential or exclusive electroplating of the lateral surfaces of the through-holes is desired. It has surprisingly been found in the case of the apparatus according to the invention that a preferential deposition of metal takes place on the lateral surfaces of the through-holes if the electrolyte is cooled. Particularly suitable for use is a temperature range from about 10° to about 30° C., preferably from about 18° to about 24° C. Therefore, it can be preferred for the apparatus to include a device with which the electrolyte can be cooled.

Preferably, the apparatus includes a sump for the electrolyte, from which the electrolyte is brought continuously into the chamber which can be charged with electrolyte and into which the electrolyte is returned again from there, and that the cooling device comprises:

a) a main cooler, by which the electrolyte located in the sump is kept below a first preselectable temperature;

b) at least one auxiliary cooler, by which the electrolyte taken from the sump can be cooled on the way to the chamber which can be charged with electrolyte and which keeps this electrolyte at a second preselectable temperature, which is lower than the first temperature.

By dividing the overall cooling effect between a main cooler and an auxiliary cooler, a particularly precise and rapid automatic control of the electrolyte temperature can be accomplished "locally", that is in the vicinity of the plastic films to be plated. The "main cooling" to the first preselectable temperature takes place already in the sump by a relatively large unit. This first preselectable temperature lies only a little above that temperature which the electrolyte is to reach "locally" The final, second temperature, which lies below the first temperature value, is then effected by the fast-operating auxiliary cooler of lower power, which only influences the electrolyte on its way to the anode.

In previously known apparatus, the plastic films are plated on both sides. Therefore, an electrode respectively extends on both sides of the path of movement of the plastic film. According to a further feature of the invention, in the case of such apparatus it is expediently envisaged that there are provided two auxiliary coolers which can be operated independently of each other, the electrolyte flowing through the first auxiliary cooler being fed to the plastic film on the side facing the one anode and the electrolyte flowing through the other auxiliary cooler being fed to the plastic film on the side facing the other anode.

In the case of one design of this type of the apparatus according to the invention, each auxiliary cooler is assigned a temperature sensor, which is arranged in the vicinity of the plastic film on the side facing the corresponding anode, monitors the local temperature there of the electrolyte and controls the assigned auxiliary cooler accordingly. If there are a plurality of anodes, it may well be expedient for making the application more uniform on the opposite sides of the plastic film to be electroplated to choose the local temperature of the electrolyte to be different, in order to be able in this way to allow for different geometrical conditions, including in the flow movement of the electrolyte.

The anode is expediently an inert dimensionally stable electrode; then there is provided a separate device, by which metal ions extracted during electroplating can be fed back to the electrolyte. The known apparatuses, mentioned at the beginning, use consuming anodes, ie. anode baskets, which are filled with the metal which is to be electroplated on. This metal then goes over into the electrolyte during the electrolysis and thus replaces those metal ions which are lost from the electrolyte due to the deposition on the items to be electroplated. However, inert electrodes, as are proposed according to the invention, result in conditions which can be better reproduced and thus permit more favourable results in plating on. In addition, the downtimes required for servicing can be shortened.

The inert anodes may, for example, be composed of platinized expanded metal or material coated with conductive oxide or of carbon.

If the apparatus according to the invention is used for copper electroplating, the device by which the copper ions extracted during electroplating can be fed back to the electrolyte may comprise:

a) a supply of metallic copper;

b) a device by which part of the electrolyte can be enriched with oxygen and can be fed to the metallic copper.

Metallic copper is not soluble in the copper sulfate solutions in sulphuric acid which are usually used. This changes if the electrolyte is additionally enriched with oxygen. The apportioned oxygen enrichment may thus be used to dissolve chemically a precise amount of metallic copper which is chosen such that the concentration of the copper ions in the electrolyte remains substantially constant.

In this connection there may be provided in particular a pump which takes electrolyte from the sump and feeds it via one or more air injectors to the supply of metallic copper. In this case, the oxygen which is required for dissolving the metallic copper is taken from the ambient air and is admixed with the electrolyte on passing through the air injectors.

BRIEF DESCRIPTION OF THE DRAWINGS

FIG. 2 shows on a greater scale one of the electroplating chambers which the apparatus of FIG. 1 contains;

FIG. 3 shows diagrammatically in plan view the orientation of the squeezing rolls which are used in the case of the apparatus of FIG. 1;

DESCRIPTION OF PREFERRED EMBODIMENTS

Figure 1:
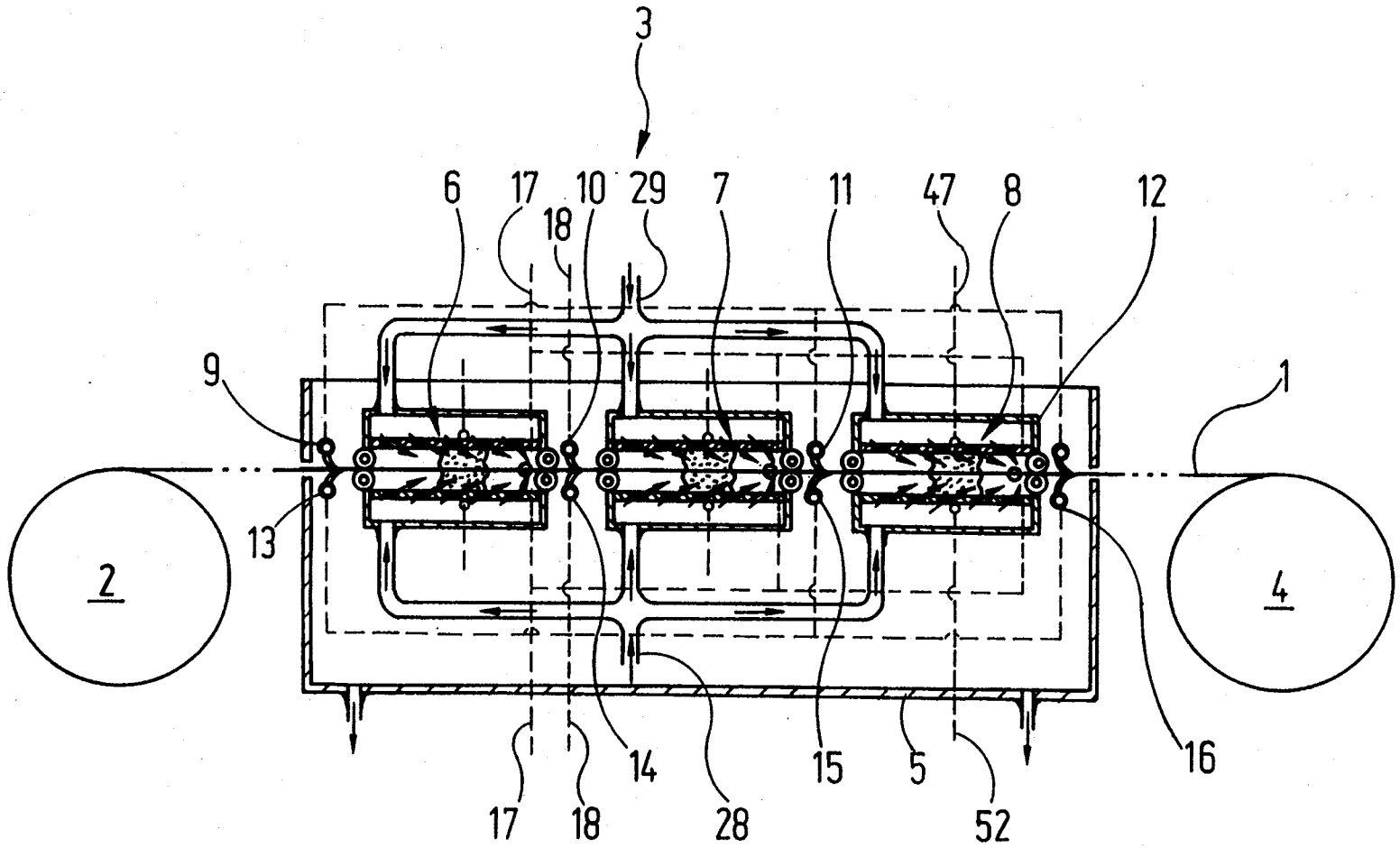
FIG. 1 shows a vertical section through an apparatus for the electroplating of thin plastic films which contain a multiplicity of through-holes.

FIG. 1 shows a vertical section through an apparatus with which thin plastic films, which are preferably composed of polyimide and have been provided with through-holes beforehand in a plasma dry-etching process, are electroplated on their upper and lower surfaces and also on the lateral surfaces of the through-holes. The plastic film 1 is drawn off from a supply reel 2 and passed through the apparatus, which is provided overall with the reference numeral 3, to a second supply reel 4, on which the treated plastic film is wound up again. The supply reels 2 and 4 need not be assigned to the electroplating apparatus 3 directly next to each other; rather, further treatment stations may be provided between the reels 2 and 4 and the electroplating apparatus 3, so that altogether there occurs a production line which is of a modular construction and through which the plastic film 1 is passed between the reels 2 and 4 continuously in a horizontal through-running manner. Examples of other such modules which come under consideration are acid-dipping, rinsing, resist-stripping and drying modules, intermediate stores, make-up stations etc. The precise construction of these further modules is of no interest in the present context.

The electroplating apparatus 3 represented in FIG. 1 comprises a machine housing 5, in which three electroplating chambers 6, 7, 8 are arranged lying one behind the other in the direction of movement of the plastic film 1. The plating of the plastic film with metal, in particular with copper, nickel, gold, tin or lead-tin, takes place in these electroplating chambers 6, 7, 8. The precise construction of these electroplating chambers 6, 7, 8 is explained further below with reference to FIG. 2.

Directly upstream and downstream of each electroplating chamber 6, 7, 8 (seen in the direction of movement of the plastic film 1) there is in each case located a bonding device 9, 10, 11, which establishes an electrical contact with the upwardly facing surface of the plastic film 1, and also further bonding devices 13, 14, 15, 16, which establish an electrical contact with the downwardly facing surface of the plastic film 1. In the case of the illustrative embodiment represented, they are designed as brushes. The bonding devices 9 to 16 are electrically connected in the way drawn in the dashed lines to one another and to the lines 17, 18, which lead to the negative pole of a circuit arrangement which generates the electroplating voltage. This circuit arrangement is explained in more detail further below with reference to FIG. 5. For the moment it is sufficient to know that the plastic film 1 is brought to cathode potential by means of the lines 17, 18 and the bonding devices 9 to 16, so that the metal can be electrolytically deposited on the plastic film 1 in the desired way in the electroplating chambers 6, 7, 8.

The bonding devices 9 to 16 are located outside the electrolyte used for electroplating, which is substantially located only inside the electroplating chambers 6, 7, 8 and in the lower region of the machine housing 5, which serves as a sump. Therefore, and on account of the fact that the bonding devices 9 to 16 are also not in the region of the anodes of the electrolysis, that is not within an electric field, it is prevented that metal is also deposited on said devices themselves. This represented a great problem in the case of the known electroplating apparatuses with which discrete circuit boards are plated.

The spacing of neighbouring bonding devices 9 to 16 (seen in the direction of movement of the plastic film 1) is chosen to be so short that the voltage drops within the plastic film 1 on the way between neighbouring bonding devices 9 to 16 are not significant, that is they are not enough to result in inhomogeneous electroplating or development of considerable Joulean heat. This is one of two aspects which determine the length of the individual electroplating chambers 6, 7, 8 (the second aspect will be dealt with further below). A spacing of neighbouring bonding devices 9 to 16 which lies between 40 and 80 cm, preferably at about 50 cm, has proved successful in practice.

When the plastic film 1 runs through the electroplating chambers 6, 7, 8 lying one behind the other, the conductivity increases on account of the increasingly applied metal layer. Therefore, it will be possible in principle to make the spacing of neighbouring bonding devices 9 to 16, and consequently the length of the electroplating chambers 6, 7, 8, increase in the direction of movement of the plastic film 1. In this way, the electrolysis could take place with constant current density over the entire extent of the electroplating apparatus 3. However, in the case of the illustrative embodiment represented, all of the electroplating chambers 6, 7, 8 are of an identical design—with the exception of a small difference, mentioned below—that is they also have in particular an identical length. This has the consequence that the current density of the electrolysis increases in tile electroplating chambers 6, 7, 8 in the direction of movement of the plastic film 1. This may be an entirely desirable effect: at the beginning of the plating operation, which in the case of the illustrative embodiment represented takes place in the electroplating chamber 6, the current density is still relatively low; the plating operation begins very carefully and gently, which improves the adherence and homogeneity of the metal layer applied right at the outset. As the metal layer becomes thicker, the electroplating can be performed more quickly without thereby putting quality at risk.

In principle it is also possible to influence the current density in the individual electroplating chambers 6, 7, 8 by varying the anode voltage respectively applied there (on account of the fact that the plastic film 1 runs through all the electroplating chambers 6, 7, 8, the cathode potential is inevitably substantially identical, since it is intended as far as possible to avoid currents running over the plastic film 1 between the bonding devices 9 to 16).

For a more detailed explanation of the construction of the individual electroplating chambers 6, 7, 8, reference is now made to FIG. 2. This shows on an enlarged scale a cutout from FIG. 1 in the region of the first electroplating chamber 6. The latter has a housing 19, the inlet of which is formed by pairs of squeezing rolls 20, 21 and the outlet of which is formed by pairs of squeezing rolls 22, 23. Above and below the plastic sheet 1 there extend, at a parallel distance from the latter, an upper anode 24 and a lower anode 25. In the case of the illustrative embodiment represented, all the anodes 24 and 25 of the electroplating apparatus 3 are connected to one another and to a line 17, which leads to the circuit arrangement represented in FIG. 5 and described below for generating the electroplating voltage. Between the anodes 24 and 25 and the housing 19 of the electroplating chamber 6 there is respectively formed a distribution space 26 and 27 for the electrolyte. The electrolyte is fed to the distribution spaces 26 and 27 via pipelines 28, 29, which are connected to the device represented in FIG. 4 and explained further below for preparing the electrolyte. The anodes 24 and 25 are provided with a multiplicity of through-holes 30, which are disposed obliquely against the direction of movement of the plastic film 1 in such a way that they converge toward one another in the direction of movement. The arrangement is obviously such that the electrolyte fed via the lines 28 and 29 to the distribution spaces 26 and 27 enters into the space between the anodes 24 and 25 and the plastic film 1 with a movement component which is parallel to the direction of movement of the plastic film 1. Two effects are accomplished by this: on the one hand, very strong one-sided pressure surges on the plastic film 1, which could have the consequence of bending out of the plastic film 1 and/or unsteady running, are avoided. On the other hand, a defined flow of the electrolyte is brought about in the space filled by the electric field between the anodes 24 and 25 and the plastic film 1, so that harmful consequences of concentration or depletion effects can be avoided. In the case of the illustrative embodiment represented in the drawing, the electrolyte passes via lateral openings 62 in the housing 19 and from there into the sump of the apparatus 3, which is located in the lower region of the machine housing 5. From there, the electrolyte (cf. FIG. 1) is brought via connection pieces 63, 64 and through the line 65, represented in FIG. 4, to the device which further prepares the electrolyte.

The plastic film 1 extends substantially freely through the electroplating chamber 6 between the pairs of squeezing rolls 20, 21 and 22, 23. The latter serve not only for terminating the space filled with field and electrolyte between the anodes 24, 25 and the plastic film 1 but at the same time as a conveying device. Further conveying devices, in particular rollers which would be arranged between the pairs of squeezing rolls 20, 21 and 22, 23, are not provided. The plastic film 1 is kept taut and flat between the pairs of squeezing rolls 20, 21 and 22, 23 by special measures, which are dealt with further below. However, in the case of very long electroplating chambers 6, seen in the direction of movement of the plastic film 1, there may also be provided, as indicated in FIG. 2, between the anodes 24 and 25 and the plastic film 1 one or more tampons 66, 67, which are composed of a very soft, open-pored plastic foam. The tampons 66, 67 permit the passage of electrolyte, but at the same time stabilize the plastic film 1 on its way between the pairs of squeezing rolls 20, 21 and 22, 23.

A tautening of the plastic film 1 takes place both in the direction of the movement and perpendicularly thereto.

The plastic film 1 is always held with tension in the direction of movement by the circumferential speed of the pairs of squeezing rolls 20 to 23 increasing progressively in the direction of movement of the plastic film 1. In actuality this means that the pairs of squeezing rolls 22, 23 are operated with a slightly greater circumferential speed than the pairs of squeezing rolls 20, 21. This continues in the downstream electroplating chambers; Thus, the entry pairs of squeezing rolls of the electroplating chamber 7 (FIG. 1) run somewhat faster than the exit pairs of squeezing rolls 22, 23 of the first electroplating chamber 6, represented in FIG. 2.

The higher circumferential speed of the pairs of squeezing rolls can be accomplished in two ways:

The simplest is to make the diameter of the pairs of squeezing rolls 20 to 23 increase slightly in the direction of movement of the plastic film 1, but to leave the rotational speed of the pairs of squeezing rolls 20 to 23 constant over the entire extent of the apparatus 3. This has the advantage that all the pairs of squeezing rolls 20 to 23 can be operated from a single drive source, for example by means of a continuous shaft which extends along one longitudinal side of the apparatus 3 and is coupled by means of pairs of bevel gears to the spindles of the pairs of squeezing rolls 20 to 23.

The second, somewhat more complex process is to make the rotational speed of the pairs of squeezing rolls 20 to 23 increase in the direction of movement of the plastic film 1, which, however, requires a design of greater complexity. In this case, the pairs of squeezing rolls, which are to run with differing rotational speed, are either assigned to different drive sources or are coupled to the common drive shaft by individual transmission ratios.

In both cases, a slip clutch is provided for avoiding overstressing of the plastic film 1. Said clutch can, for example, be realized in a simple way by it being possible for the lateral shell of the pairs of squeezing rolls 20 to 23 to be rotatable with respect to the coaxial drive shaft and coupled to the latter by a defined friction. Better, however, is an adjustable slip clutch which is inserted into the drive path and, for example, comprises two plates which can be pressed against each other. The circumferential speeds of the various pairs of squeezing rolls 20 to 23 are then respectively set such that the friction clutches respond, that is the plastic film 1 is subjected to a maximum tension which is predetermined and limited by the friction clutches.

For tautening the plastic film 1 in the transverse direction, that is perpendicularly to the direction of movement, the pairs of squeezing rolls 20, 21 and 22, 23 are divided into two, as is diagrammatically represented in FIG. 3. Thus, in fact they are in each case composed of two pairs of squeezing rolls 20', 20'', 21', 21'', 22', 22'', 23', 23', which are disposed with respect to the direction of movement of the plastic film 1 in such a way that they converge in the direction of movement and thereby enclose an obtuse angle. Suitable for use here are angles in the range between 120° and 190°, preferably at about 150°. Due to the dividing into two and angled disposing of the pairs of squeezing rolls 20, 21, 22, 23, when the pairs of squeezing rolls rotate there is generated not only a force component which drives the plastic film 1 ill the direction of movement but also a force component which is perpendicular thereto and acts on the plastic film 1 perpendicularly to the direction of movement and thus tautens said film.

In the case of an alternative illustrative embodiment, which is not represented in the drawing, the pairs of squeezing rolls 20, 21, 22, 23 at the inlet and outlet of each electroplating chamber 6, 7, 8 are in one piece and are perpendicular to the direction of movement of the plastic film 1. The effect on the plastic film 1, tautening it in the lateral direction, is then produced by correspondingly obliquely disposed bonding rollers, which are used instead of-the brush-like bonding devices 9 to 16 represented in FIG. 1. If appropriate, it is also possible to arrange both the pairs of squeezing rolls and the just-mentioned bonding rollers at a corresponding angle.

Since, as already described, the pairs of squeezing rolls 20, 21, 22, 23 are used as a single drive source, since in particular no lateral drive rollers are thus used, it is possible with the electroplating apparatus represented in FIG. 1 to process plastic films 1 of a wide variety of widths without the machine having to be readjusted for this purpose. If anything, it may be necessary to cover those anode regions inside the electroplating chambers 6, 7, 8 which project laterally beyond the plastic film 1, in order to eliminate field distortions in the region of the lateral edge of the plastic film 1.

With the bonding devices 9 to 16 the situation in this respect is as follows: in general the bonding device 9 to 16 act only on one or both edges of the plastic film 1, where the latter is provided with a special metal strip for this purpose. If the bonding takes place on both sides, in the event of the width of the processed plastic film 1 being changed it is necessary to adjust correspondingly at least the bonding devices on one side. If it is sufficient, for example in the case of relatively narrow plastic films 1, to bond exclusively on one side, a readjustment of the bonding devices is not necessary in the event of the film width being changed: all the plastic films are introduced into the apparatus such that the edge to be bonded is always at the same place.

Figure 4:
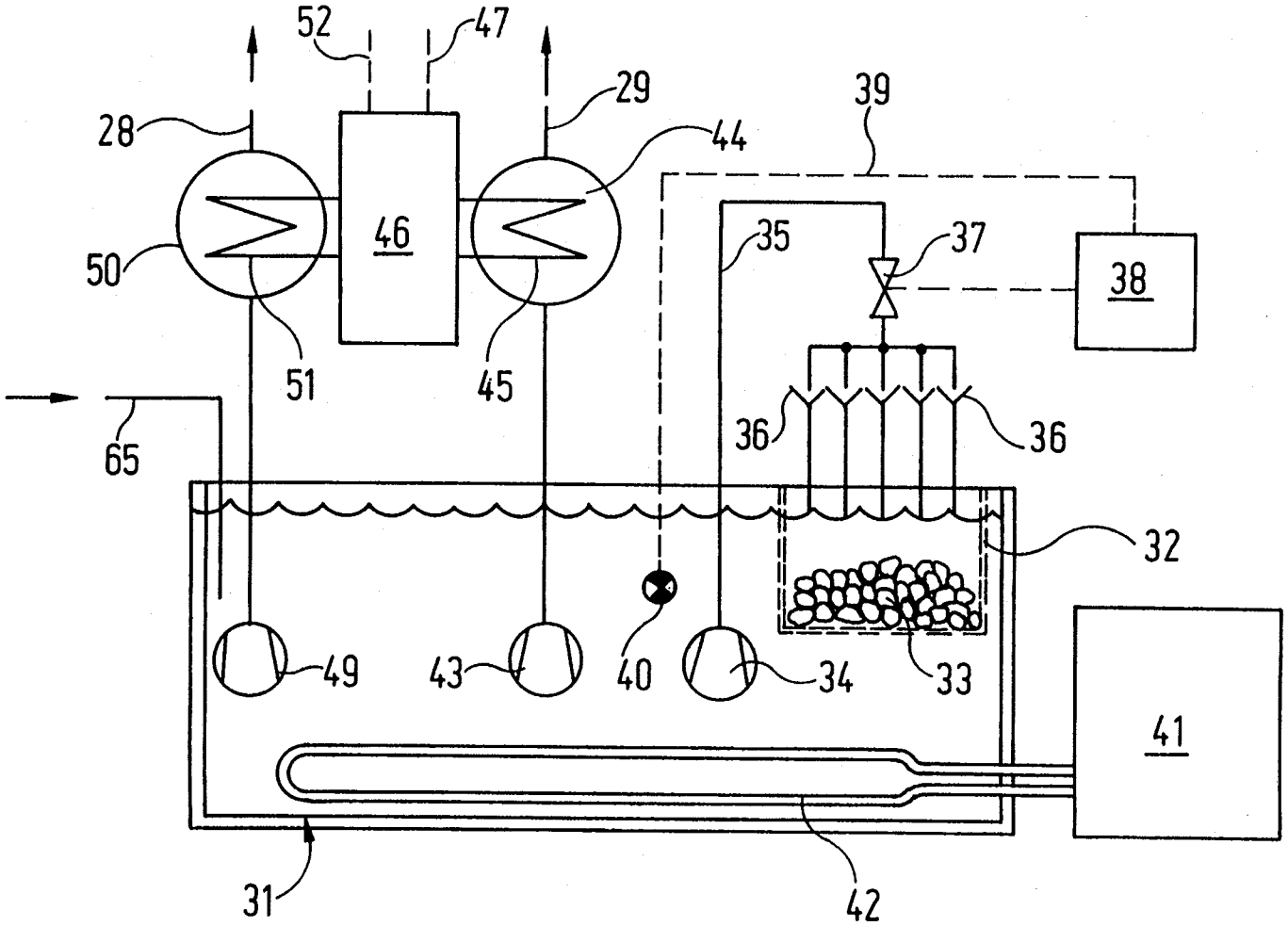
FIG. 4 diagrammatically shows the device for preparation of the electrolyte which is used in the apparatus of FIG. 1.

Represented in FIG. 4 is that device which serves for preparing the electrolyte, which is introduced into the apparatus 3 represented in FIG. 1 via the lines 28, 29 and is removed again from this apparatus 3 via the connection pieces 22, 23. Since the apparatus operates with inert anodes 24, 25, the copper which is electroplated onto the plastic film must be fed via the electrolyte. Moreover, as will become clear later, the electrolyte requires a certain controlling of its temperature. Both types of "preparation" take place in the device shown in FIG. 4.

This device comprises a container 31, which serves as a sump for the electrolyte and is filled up to a certain level with electrolyte. A permeable basket 32, in which there is copper scrap 33, is submersed into said electrolyte. The copper scrap 33 is not dissolved by the electrolyte itself, which is substantially composed of copper sulfate in sulfuric acid. The introduction of copper ions into the electrolyte takes place as follows:

A pump 34 takes electrolyte from the sump 31 and feeds it via a line 35 to a multiplicity of air injectors 36 connected in parallel. In the air injectors 36, the electrolyte is enriched with atmospheric oxygen and is directed thus onto the copper scrap 33 in the container 32. With the aid of the atmospheric oxygen, the electrolyte can then dissolve the copper scrap 33, so that additional copper ions enter into the electrolyte.

The copper content in the electrolyte may vary in broad limits, approximately between 0.5 and 60 g/l, preferably between 2.5 and 50 g/l. Particularly typical is a copper concentration of 25 g/l. In addition, about 10 g/l of EDTA are often used as an additive.

In the line 35 there lies a solenoid valve 37, which is controlled by an automatic control device 38 for the copper content of the electrolyte. The automatic control device 38 is connected via a line 39 to a sensor 40 arranged in the electrolyte. Said sensor monitors the concentration of the copper ions in the electrolyte, for example by establishing the density of the electrolyte, or by photometric means. If the copper ion concentration in the electrolyte drops below a certain value, the automatic control device 38 opens the solenoid valve 37. Then electrolyte enriched with atmospheric oxygen can impinge on the copper scrap 33 via the air injectors 36 and keep dissolving copper ions out of said scrap until the copper ion concentration monitored by the sensor 40 has again reached the desired value. Then the automatic control device 38 closes the solenoid valve 37.

By controlling the temperature of the electrolyte, as already mentioned, it is possible to influence where the copper is preferentially deposited on the plastic film 1 during the electrolysis in the apparatus 3 of FIG. 1. It has been found that cooling of the electrolyte has the result that the metal deposition takes place preferentially on the lateral surfaces of the through-holes. Particularly favourable is a temperature range between 10° and 30° C., preferably between 18° and 24° C. For this reason, the electrolyte is additionally cooled by the device represented in FIG. 2. For this purpose, there is initially provided a main cooling device 41, which supplies a cooling coil 42 arranged in the sump 31 with coolant. The electrolyte located in the sump 31 is kept at a certain basic temperature by the cooling coil 42.

A pump 43 takes such precooled electrolyte from the sump 31 and feeds it via the line 29 to the apparatus 3 shown in FIG. 1. In the line 29 there lies an auxiliary cooler 44, the cooling coil 45 of which is supplied by an auxiliary cooling device 46. The auxiliary cooling device 46 is in connection via an electrical line 47 with a temperature sensor 48, which is arranged in the region of the plastic film 1 to be electroplated on the side facing the upper inert anode 424 (FIG. 2). The temperature sensor 47 measures the local temperature prevailing there of the electrolyte. If this temperature increases above a certain value, the auxiliary cooling device 46 thus ensures by charging the cooling coil 45 in the auxiliary cooler 44 that the temperature in the region of the sensor 48 drops again in the corresponding way.

A further pump 49 takes electrolyte from the sump 31 of the device of FIG. 4 and feeds it via the line 28 to the apparatus 3 represented in FIG. 1. In the line 28 there lies a further auxiliary cooler 50, the cooling coil 51 of which is supplied independently of the cooling coil 45 from the auxiliary cooling device 46. For this purpose, the auxiliary cooling device 46 is connected via an electric line 52 to a temperature sensor 53, which is arranged in the region of the plastic film 1 to be electroplated, on the side facing the lower anodes 25, and measures the local temperature there. With the aid of the temperature sensor 53, the auxiliary cooling device 46 and the auxiliary cooler 50, this local temperature of the electrolyte is kept below a certain value, which may well differ from the set value of the temperature on the other side of the plastic film 1 to be electroplated. Since the basic cooling of the electrolyte is already provided in the sump by the main cooling device 41, or the cooling coil 42 of the latter, the power of the auxiliary cooling device 46 need not be designed to be very great. The temperature of the electrolyte in the sump 31 is already quite close to the set values of the temperatures in the region of the upper and lower anodes 24, 25, so that the corrective adjustment to these set values by the auxiliary coolers 44 and 50 can take place very rapidly and with little hunting.

Figure 5:
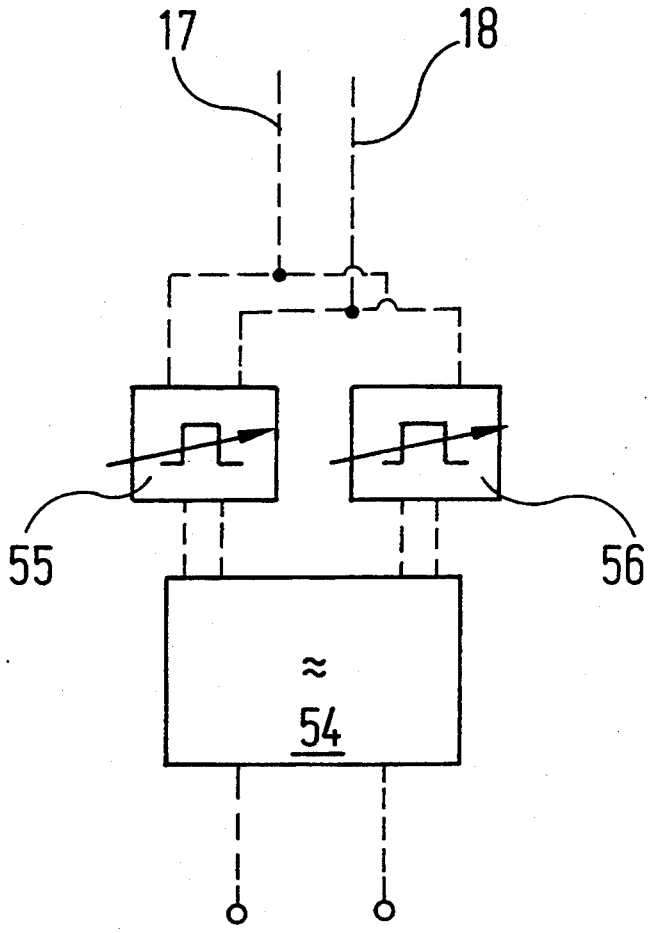
FIG. 5 shows a block diagram of the circuit arrangement by which the electroplating voltage for the apparatus represented in FIG. 1 is generated.

The electroplating current source for the apparatus of FIG. 1 is shown in FIG. 5. It comprises a diagrammatically represented transformer 54, which is connected on the primary side to the system voltage and on the secondary side to two pulse generators 55, 56. The pulse generators 55 and 56 can in each case generate independently of each other square-wave pulses of which the frequency, clock ratio, amplitude, polarity and relative phase position are substantially freely selectable. The output signals of the two pulse generators 55 and 56 are superposed and fed via the lines 17 and 18, respectively, to the electrodes of the apparatus 3 of FIG. 1. Consequently, a pulsed direct voltage lies across the electrodes (anodes 24, 25, bonding devices 9 to 16 and thus ultimately the plastic film 1 itself). In a way corresponding to the function of the apparatus 3, on average over time there predominantly lies a positive voltage across the anodes 24, 25; during certain periods of time, however, a polarity reversal may take place such that the anodes 24, 25 are negative with respect to the bonding devices 9 to 16 and consequently with respect to the plastic film 1. During these time phases, the copper layer deposited on the plastic film 1 is briefly removed again somewhat. In addition, polarization and concentration effects are largely eliminated in the vicinity of the electrodes of the apparatus 3 of FIG. 1. The pulses emitted by the two pulse generators 55 and 56 are optimized for the respective intended use and adapted to the given geometry of the apparatus 3 and to the chemical composition and temperature of the electrolyte. In the event of optimum adjustment, which is to be determined by specific series of tests, very high deposition rates of several $\mu$ per meter at a speed of movement of about one meter per minute of the plastic film 1 can be accomplished. This means that, in an apparatus 3 of which the overall length does not exceed 5 meters, a layer of a thickness of 25 $\infty$ can be electroplated on in one step. The precautionary layer of a thickness of 4–5 $\mu$ separately applied before now in the case of operations electroplating circuit boards can be dispensed with.

What is claimed is:

1. Apparatus for the electroplating of thin plastic films, provided on one or both sides with a conductive coating, which comprises:

a) at least one assigned supply reel for the plastic film to be electroplated;

b) at least one assigned supply reel for the electroplated plastic film;

c) a conveying device which conveys the plastic film continuously from one supply reel to the other;

d) at least one chamber which can he charged with electrolyte, which chamber lies between the supply reels and in which there is located in the vicinity of the path of movement of the plastic film at least one anode which is electrically connected to the one pole of an electroplating current source;

e) at least one contacting device which is electrically connected to the other pole of the electroplating current source and establishes contact with the moving plastic film; and f) wherein said conveying device further comprises at least one pair of squeezing rolls at both the inlet and at the outlet of each electroplating chamber and wherein the circumferential speed of the pairs of squeezing rolls increases in the direction of movement of the plastic film; and the conveying device is set up such that the plastic film runs horizontally in the entire region of the chamber which can be charged with electrolyte.

2. Apparatus as claimed in claim 1, in which the contacting device is arranged outside the chamber.

3. Apparatus as claimed in claim 2, in which the chamber is subdivided into a plurality of electroplating chambers which are arranged one behind the other, in the direction of movement of the plastic film.

4. Apparatus as claimed in claim 3, in which contacting devices are arranged upstream of, between and downstream of the electroplating chambers.

5. Apparatus as claimed in claim 3, in which the length of the electroplating chambers increases in the direction of movement of the plastic film.

6. Apparatus as claimed in claim 3, in which all the electroplating chambers in the apparatus have the same length.

7. Apparatus as claimed in claim 3, in which the potential lying at the at least one electroplating chamber is different.

8. Apparatus as claimed in claim 3, in which there are two pairs of squeezing rolls at the inlet and outlet of each electroplating chamber arranged in such a way that they converge toward each other in the direction of movement of the plastic film and enclose an obtuse angle.

9. Apparatus as claimed in claim 8, in which the obtuse angle is from about 120° to about 190°.

10. Apparatus as claimed in claim 9, in which the obtuse angle is about 150°.

11. Apparatus as claimed in claim 3, in which the diameter of the pairs of squeezing rolls increases in the direction of movement of the plastic film.

12. Apparatus as claimed in claim 11, which includes a slip clutch for each squeezing roll, which limits the torque transferred to the lateral surface of the squeezing roll to a maximum value.

13. Apparatus as claimed in claim 3, in which the rotational speed of the pairs of squeezing rolls increases in the direction of movement of the plastic film.

14. Apparatus as claimed in claim 1, in which the contacting device is formed by lateral pairs of contact rollers, the axes of pairs of contact rollers being arranged opposite to one another on opposite sides of the plastic film, and converging toward each other in the direction of movement of the plastic film to enclose an obtuse angle.

15. Apparatus as claimed in claim 1, which includes a tampon of soft, open-pored plastic foam located inside the chamber on each side of the plastic film, between the film and respective stationary parts, which can be charged with electrolyte.

16. Apparatus as claimed in claim 15, in which the stationary parts are anodes.

17. Apparatus as claimed in claim 1, in which a plurality of holes are provided through which the electrolyte can enter the chamber, the holes being designed symmetrically with respect to the plastic film.

18. Apparatus as claimed in claim 17, in which two of the said holes are provided, disposed obliquely in such a way that they converge toward each other in the direction of movement of the plastic film.

19. Apparatus as claimed in claim 17, which includes at least one anode, the hole through which electrolyte can enter the chamber being formed in the anode.

20. Apparatus as claimed in claim 1, in which the electroplating current source comprises at least one adjustable pulse generator and an anode, the output signals of which are applied to the anodes and the contacting device and are square-wave pulses of selectable repetition frequency, duty cycle, amplitude and polarity, the anode being positive on average over time with respect to the contacting device.

21. Apparatus as claimed in claim 20, in which the electroplating current source comprises at least two pulse generators, each of said pulse generators being adapted to independently generate an output signal having a relatively adjustable phase position summing means being provided for summing said output signals and for applying said summed output signals to the anode and the bonding device, respectively.

22. Apparatus as claimed in claim 20, in which the pulse generator or generators generate such output signals that during part of the time of output signal generation, the voltage effectively lying across the anode or the contacting device has the reverse polarity, at which the anode is negative with respect to the contacting device.

23. Apparatus as claimed in claim 20, in which the repetition frequency of the output signals of the pulse generator is from about 0.1 to about 10,000 Hz.

24. Apparatus as claimed in claim 20, in which the anode is an inert dimensionally stable electrode and there is provided a separate device by which the metal ions extracted during electroplating can be fed back to the electrolyte.

25. Apparatus as claimed in claim 24, in which the anode is made from platinized expanded metal or material coated with conductive oxide or of carbon.

26. Apparatus as claimed in claim 24 for copper electroplating, in which the device by which the ions extracted during electroplating can be fed back to the electrolyte comprises:

a) a supply of metallic copper;

b) a device by which part of the electrolyte can be enriched with oxygen and can be fed to the metallic copper.

27. Apparatus as claimed in claim 26, which includes a pump which takes electrolyte from a sump and feeds it via one or more air injectors to the supply of metallic copper.

28. Apparatus as claimed in claim 1, which includes a device for cooling the electrolyte.

29. Apparatus as claimed in claim 28, which includes a sump for the electrolyte, from which the electrolyte is brought continuously into the chamber which can be charged with electrolyte and into which the electrolyte is returned again from there, and in which the cooling device comprises:

a) a main cooler, by which the electrolyte located in the sump is kept below a first preselectable temperature;

b) at least one auxiliary cooler, by which the electrolyte taken from the sump can be cooled on the way to the chamber which can be charged with electrolyte and which keeps this electrolyte at a second preselectable temperature, which is lower than the first temperature.

30. Apparatus as claimed in claim 29, which includes at least two anodes provided one on each side of the film extending parallel to the path of movement of the plastic film, and two auxiliary coolers which can be operated independently of each other, the electrolyte flowing through the first auxiliary cooler being fed to the plastic film on the side facing the one anode and the electrolyte flowing through the other auxiliary cooler being fed to the plastic film on the side facing the other anode.

31. Apparatus as claimed in claim 30, in which each auxiliary cooler has an associated temperature sensor which is arranged in the vicinity of the plastic film on the side facing the corresponding anode, monitors the temperature there of the electrolyte and controls the assigned auxiliary cooler accordingly.

* * * * *